US007530134B2

(12) United States Patent
Frucco et al.

(10) Patent No.: US 7,530,134 B2
(45) Date of Patent: May 12, 2009

(54) METHOD FOR WASHING SPORTSWEAR

(75) Inventors: Giuseppe Frucco, Pordenone (IT); Claudio Favot, Pordenone (IT); Loween J. Clayberg, Webster City, IA (US)

(73) Assignee: Electrolux Home Products Corporation N.V., Zaventem (BE)

( * ) Notice: Subject to any disclaimer, the term of this patent is extended or adjusted under 35 U.S.C. 154(b) by 502 days.

(21) Appl. No.: 11/259,064

(22) Filed: Oct. 27, 2005

(65) Prior Publication Data

US 2006/0101590 A1 May 18, 2006

(30) Foreign Application Priority Data

Nov. 12, 2004 (EP) ..... 04105724

(51) Int. Cl.
*D06F 33/00* (2006.01)
*D06F 35/00* (2006.01)

(52) U.S. Cl. ..... 8/159

(58) Field of Classification Search ..... 8/158, 8/159; 68/12.01, 12.12
See application file for complete search history.

(56) References Cited

U.S. PATENT DOCUMENTS 2,656,700 A * 10/1953 Smith ..... 68/23.4
4,794,661 A 1/1989 Durazzani

FOREIGN PATENT DOCUMENTS

| | | | |
|---|---|---|---|
| AT | 398 439 | | 12/1994 |
| DE | 3415511 | A1 | 10/1985 |
| DE | 3821406 | A1 | 12/1989 |
| DE | 19534431 | A1 | 3/1997 |
| EP | 0 501 240 | A1 | 9/1992 |
| GB | 484715 | | 5/1938 |
| GB | 2 145 119 | A | 3/1985 |
| JP | 6-335591 | | 12/1994 |

* cited by examiner

*Primary Examiner*—Joseph L Perrin
(74) *Attorney, Agent, or Firm*—Wenderoth, Lind & Ponack, L.L.P.

(57) ABSTRACT

Method for washing sportswear items in a traditional-type rotating-drum clothes washing machine, the method comprising at least a main wash phase, a rinse phase and a final spin-extraction phase, wherein a preliminary wash phase to be performed in cold water, without any detergent addition and under reduced mechanical agitation of the clothes is carried out in advance of the main wash phase. This preliminary wash phase is followed by a soil settling step with the machine at a standstill, and a subsequent water outlet step.

6 Claims, No Drawings

METHOD FOR WASHING SPORTSWEAR

BACKGROUND OF THE INVENTION

I. Field of the Invention

The present invention refers to a method that has been particularly conceived for washing clothes used by people when practicing sports.

II. Description of Related Art

Currently available clothes washing machines are designed so as to be able to perform a number of washing cycles, or programs, that are suitable for handling various types and kinds of fabrics and clothes (delicates, synthetics, cottons, and the like). A washing program generally includes a pre-wash phase, a main wash phase, one or more rinse phases, and a final spin-extraction phase. In connection with these program phases, the program sequence control unit of the washing machine enables various process parameters to be selected, such as the amount of water to be inserted into the washing tub, the temperatures to which the water is to be heated, the amount of washing products and rinsing aids to be added, and the rotating speed of the drum holding the clothes.

SUMMARY

However, the prior art does not include, nor has there been proposed, a particular washing program for specifically handling clothes that are worn by people practicing sports, in particular such sports as football, rugby, cross-country cycle racing, and the like, in which the athlete comes into contact with soil of a solid kind, or soil containing solid particles, such as mire, sand, mud, and the like. Soil of this kind, especially when allowed to dry, does not necessarily require being washed with hot water and detergent; actually, it most often is eliminated by vigorously shaking up the clothes before putting them in the washing machine.

However, a fact that must be duly considered is that sportswear items are increasingly being made using special fibres, in particular, a synthetic kind, which needs to be handled using the utmost care, i.e. by carefully avoiding too strong mechanical stresses, thermal shocks and aggressive washing chemicals.

It therefore is a main object of the present invention to provide an improved washing method for handling sportswear, i.e. clothes worn by people when practicing sports, which is capable of being performed automatically in a clothes washing machine of a traditional kind, in such a manner as to effectively remove solid soil prior to starting with the regular washing cycle.

Another purpose of the present invention is to provide the above-noted method, while cutting the energy, water and chemical usage values of the washing machine, owing to a pre-wash phase to be carried out with hot water and without washing products.

Yet a further purpose of the present invention is to provide a method that is capable of most delicately handling the sportswear items to be washed, which are generally made of special textile materials, so as to avoid exposing them to thermal and chemical stresses.

According to the present invention, these aims as set forth above are reached in a washing method that includes a preliminary washing phase to be carried out in cold water and without any detergent addition, in which the clothes are submitted to just a reduced mechanical agitation, this preliminary wash phase being carried out in advance of the actual wash phase.

Features and advantages of the present invention will be more readily understood from the description that is given below by way of non-limiting example.

DETAILED DESCRIPTION OF THE INVENTION

The wash process according to the present invention is carried out automatically in a clothes washing machine of a kind known as such in the art, which is adapted to normally carry out washing programs that include at least a wash phase, a rinse phase and a final spin-extraction phase. These programs, or cycles as they are also referred to in the art, are selected by the user with the help of a program selection and control switch, which the washing machine is normally provided with, as well as a set of selector switches that enable the process parameters, such as the amount of water to be let in, the washing temperature, the amount of washing product to be added, the rotating speed of the drum holding the clothes to be washed, and the like, to be individually selected for each such cycle depending on the different types and loads of clothes to be handled.

The method according to the present invention contemplates that—for washing sportswear items—before the actual wash phase is started a preliminary wash phase is carried out in cold water and without any detergent addition, in which the clothes themselves are submitted to just a reduced mechanical agitation.

This preliminary wash phase must be performed at a sufficiently high level of water in the tub of the machine, preferably at the highest water level required for a corresponding load of clothes. Moreover, the drum holding the clothes to be washed must be driven to rotate at a low speed of less than 50 rpm for a period of time that should in no case exceed 3 minutes. In this manner, the effective removal of any particular soil that may mechanically adhere to the clothes, such as mire, mud and sand, is achieved without submitting the special textiles, of which such sportswear items are generally made, to any excessive wear and tear.

The above-indicated process parameters may, of course, vary according to the actual diameter of the clothes holding drum. In particular, the process parameters indicated above generally apply to European-type clothes washing machines, whereas in non-European countries, where washing machines with larger-diameter clothes holding drums are generally used, the rotating speed of these drums should be reduced accordingly.

The fact that this preliminary wash phase is carried out with cold water, under no addition of any detergent product and at a reduced rotating speed of the clothes holding drum, has the additional advantage that such phase is very economical on its whole.

A quite important feature in this preliminary wash phase is the ability of the so removed soil to settle on the bottom of the washing tub, or in the strainer of the washing machine, so as to allow for it to be capable of being effectively removed therefrom before the next wash phase is started. As a result, upon completion of this preliminary phase, a special soil settling phase follows with the machine at a standstill for a predetermined time, followed by a water discharge phase in which the water is let out of the machine with the drum rotating at a slow speed.

After this water outlet phase, a suitable pause may be provided, during which the machine is switched off and the user is enabled to add the washing products and start the actual wash cycle. This pause may be appropriately signalled to the user by means of any suitable optical (indicator lights) or acoustical (buzzer) warning means of a more or less traditional type. This pause step may be avoided in a clothes washing machine that is provided with a drawer-like or similar multi-compartment detergent dispenser. In this case, the initial detergent-free water required for the preliminary wash phase would be let in either through the compartment provided for the pre-wash detergent or directly into the tub via a proper offshoot or branch of the water supply conduit connected to the water delivery line.

The invention claimed is:

1. A method for washing sportswear items in a washing machine that includes a clothes holding drum rotatable contained in a washing tub, the method comprising:

a main wash phase including rotating the clothes holding drum at a main wash speed;

a preliminary wash phase performed prior to said main wash phase, said preliminary wash phase including washing the sportswear items in cold water without any detergent and rotating the clothes holding drum at a preliminary wash speed that is lower than the main wash speed, so as to remove soil that is adhered to the sportswear items;

a soil settling phase performed after said preliminary wash phase, said soil settling phase including stopping the rotation of the clothes holding drum and maintaining the clothes holding drum in a stationary position for a predetermined time, such that the soil removed by said preliminary wash phase settles on a bottom of the washing tub; and a water discharge phase performed after said soil settling phase, said water discharge phase including discharging the cold water from the clothes holding drum.

2. The method according to claim 1, wherein in said preliminary wash phase, the first speed is less than 50 rpm, and the time of said preliminary wash phase does not exceed 3 minutes.

3. The method according to claim 1, wherein said preliminary wash phase is performed at a highest water level required in any of the other phases.

4. The method according to claim 2, wherein said preliminary wash phase is performed at a highest water level required in any of the other phases.

5. The method according to claim 1, wherein the preliminary wash speed is a first lower speed, and the water discharge phase is performed with the drum rotating at a second lower speed that is lower than the main wash speed.

6. The method according to claim 1, further comprising:

a selection phase performed before said preliminary wash phase, said selection phase including selection of at least one of water amount in the main wash phase, water temperature in the main wash phase, the main wash speed, and the preliminary wash speed.

* * * * *